US008590160B2

(12) United States Patent
Lehane, Jr. et al.

(10) Patent No.: US 8,590,160 B2
(45) Date of Patent: Nov. 26, 2013

(54) GRID RUNNER CAP ANCHORING LANCE

(71) Applicant: USG Interiors, LLC, Chicago, IL (US)

(72) Inventors: James J. Lehane, Jr., McHenry, IL (US); Steven E. Farley, Wellington, OH (US); Donald J. Leahy, North Olmsted, OH (US); Ronald J. Koval, Aurora, IL (US); Paul A. Pomeroy, Spencer, OH (US)

(73) Assignee: USG Interiors, LLC, Chicago, IL (US)

( * ) Notice: Subject to any disclaimer, the term of this patent is extended or adjusted under 35 U.S.C. 154(b) by 0 days.

(21) Appl. No.: 13/727,633

(22) Filed: Dec. 27, 2012

(65) Prior Publication Data

US 2013/0118223 A1 May 16, 2013

Related U.S. Application Data

(62) Division of application No. 13/109,286, filed on May 17, 2011, now Pat. No. 8,359,803.

(51) Int. Cl.

| | |
|---|---|
| ***B21D 47/00*** | (2006.01) |
| ***B21K 23/00*** | (2006.01) |
| ***B23P 15/12*** | (2006.01) |

(52) U.S. Cl.

USPC ..... 29/897.31; 29/897.3; 29/897.35; 52/506.08; 52/506.09; 52/506.06

(58) Field of Classification Search

USPC ..... 52/506.09, 506.07, 506.01, 667, 52/506.06, 506.08; 29/897.35, 897.312, 29/897.31, 432.2, 432, 521, 897.3; D25/131; 72/199

See application file for complete search history.

(56) References Cited

U.S. PATENT DOCUMENTS

| | | | | |
|---|---|---|---|---|
| 4,206,578 | A | | 6/1980 | Mieyal |
| 4,489,529 | A | * | 12/1984 | Ollinger et al. ..... 52/506.07 |
| 4,525,973 | A | | 7/1985 | Vukmanic et al. |
| 4,601,153 | A | | 7/1986 | Dunn et al. |
| 4,712,350 | A | | 12/1987 | Vukmanic |
| 4,817,357 | A | | 4/1989 | Hocevar |
| 4,989,387 | A | | 2/1991 | Vukmanic et al. |
| 5,044,138 | A | | 9/1991 | Zaccardelli et al. |

(Continued)

OTHER PUBLICATIONS

Notification of Transmittal of the International Search Report and the Written Opinion of the International Searching Authority, or the Declaration of PCT/US12/037863, filed May 15, 2012. International Search Report and Written Opinion dated Aug. 8, 2012.

*Primary Examiner* — Chi Q Nguyen
(74) *Attorney, Agent, or Firm* — Pearne & Gordon LLP

(57) ABSTRACT

An elongated grid runner, and its manufacture, comprising a pair of overlying metal strips roll-formed together into a shape suitable for use in a rectangular grid to support ceiling panels, one of said strips serving as a visible cap for concealing the other strip forming the main body of the grid runner when the grid member is employed in a completed ceiling, the strips being lanced at each end of the grid runner to lock the cap strip on the main body strip whereby when the overlying strips are simultaneously cut to a finish length prior to finish roll-forming, the ends of the strip are maintained in substantially overlying end-to-end registration where the cap is visible in a finished ceiling.

1 Claim, 4 Drawing Sheets

(56) References Cited

U.S. PATENT DOCUMENTS

| | | | | |
|---|---|---|---|---|
| 5,394,665 | A | 3/1995 | Johnson | |
| 5,761,868 | A * | 6/1998 | LaLonde et al. | 52/506.07 |
| 5,839,246 | A | 11/1998 | Ziegler et al. | |
| 5,979,055 | A * | 11/1999 | Sauer et al. | 29/897.35 |
| 6,047,511 | A * | 4/2000 | Lehane et al. | 52/506.07 |
| 7,478,787 | B2 * | 1/2009 | Bankston et al. | 248/343 |
| 7,516,585 | B2 | 4/2009 | Lehane, Jr. et al. | |
| 2006/0162270 | A1 | 7/2006 | Maisch et al. | |

* cited by examiner

GRID RUNNER CAP ANCHORING LANCE

CROSS REFERENCE TO RELATED APPLICATION

This application is a division of application Ser. No. 13/109,286, filed May 17, 2011, now U.S. Pat. No. 8,359,803.

BACKGROUND OF THE INVENTION

The invention relates to grid runners for suspended ceilings and, in particular, to roll-formed grid runners made from two separate metal strips.

PRIOR ART

A common method of producing suspended ceiling grid runners is a roll-forming process in which a strip or two strips are passed through roller sets to obtain a desired cross-sectional shape. The most common shape is that of an inverted tee, hence the term grid tee. Specialty grid runner shapes may require more elaborate roll sets to produce the desired cross-sectional configuration. A problem can arise where the grid runner is formed of a main body strip and an appearance strip or cap that are roll formed after being finish cut to length. The forming process may be prone to cause one of the strips to permanently change its length relative to the other strip in the rolling process. This phenomena can result in an objectionable appearance such as where the body, which typically is not painted, is not concealed at the ends of the runner by the appearance cap which typically is painted.

SUMMARY OF THE INVENTION

The invention overcomes a problem that can occur in the manufacture of roll-formed multi-strip grid runners. Such runners may have a tendency to develop different lengths of the strips when they are subjected to roll forming. The invention provides a technique for locking the strips of a multiple strip grid runner together to enable the strips to be successfully roll-formed without a change in length of one of the strips relative to the other. In various types of grid runner profiles, it can be necessary or desirable to trim the component strips to length after they have been initially rolled together into a pre-form. The final profile may be difficult or impractical to shear to a finish length so that the length of the finished grid member is established before it is subjected to the final roll-forming steps. The inventive technique permits the strips, joined in a pre-form state, to be cut to length, such as by a shear, and after being locked together in accordance with the invention, to be roll-formed to a finished shape.

In the preferred embodiment, the grid runner strips are locked together locally adjacent each end of the grid runner. It has been found that an effective manner of locking the strips together is to lance overlapping layers of the strips at each end of the runner. In the disclosed embodiment, two small lances are cut into abutting areas of the strips. The lances are located on each side of a central plane of the grid runner. Additionally, the lances are oriented to resist relative movement of the ends of the cap strip inward from the ends of the main body and are configured to reduce their visibility.

DESCRIPTION OF THE PREFERRED EMBODIMENT

Figure 1:
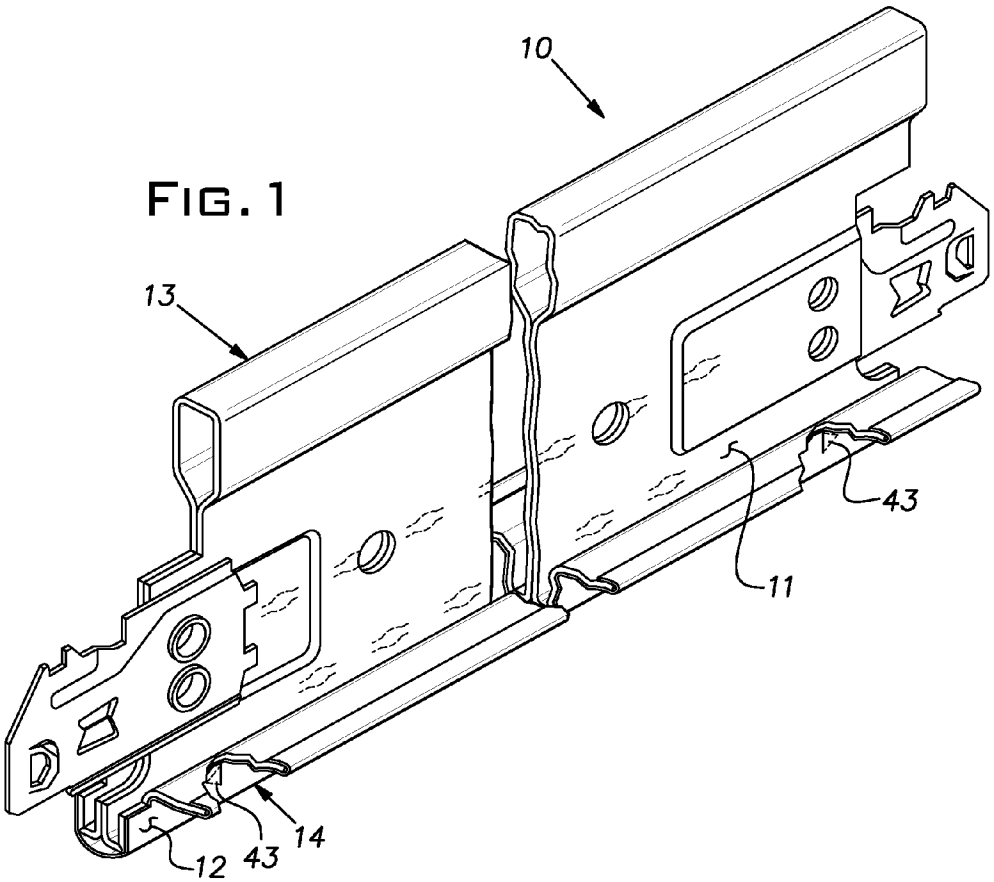
FIG. 1 is a fragmentary perspective view of both ends of a grid runner embodying the invention; it will be understood that both ends of the grid runner are essentially identical.

FIG. 1 illustrates an example of a grid runner 10, sometimes referred to as a grid tee. The grid runner 10 is used to assemble a suspended rectangular grid that supports ceiling tiles to form a suspended ceiling. A method of producing the illustrated grid runner configuration is disclosed in U.S. patent application Ser. No. 12/848,267, filed Aug. 2, 2010, the disclosure of which is incorporated herein by reference. The grid runner 10 is made by roll-forming two sheet metal strips 11, 12. A first of the strips 11 forms a main body of the grid runner 10 and can, for example when made of steel, have a nominal gauge to meet structural support requirements when it forms a twelve foot main runner and an equivalent or slightly reduced thickness when it forms a 2 foot or 4 foot cross runner.

The strip 12 forms an appearance cap 14 and when made of steel can have a much thinner gauge. The cap 14, as is typical, is painted on its side not in contact with the main body 13 and is that part of the grid runner 10 that is visible from below a finished suspended ceiling.

Figures 2, 3, 4:
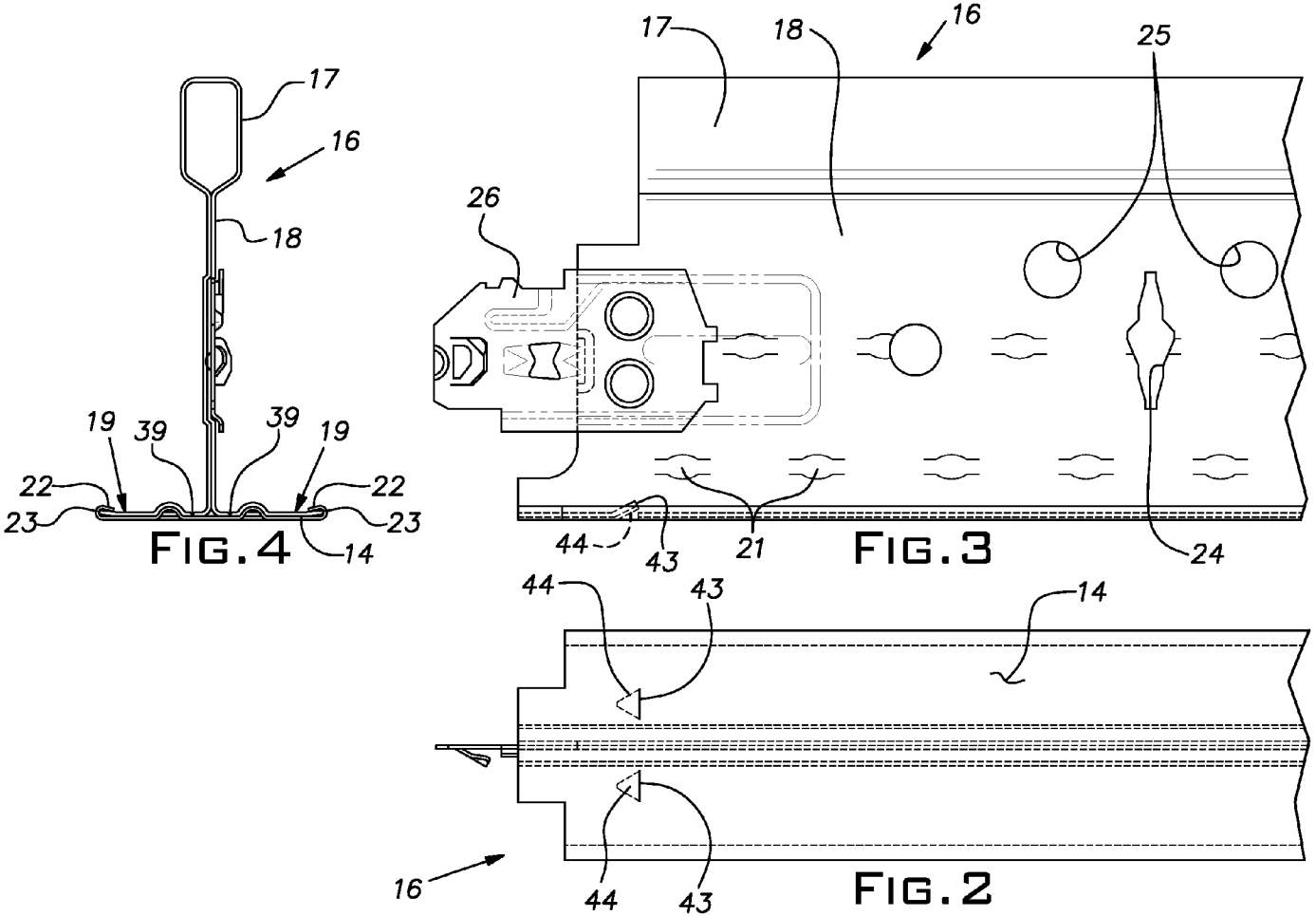
FIG. 2 is a bottom view of an end of a pre-form of the grid runner of FIG. 1.
FIG. 3 is a side view of the pre-form of the grid runner of FIG. 1.
FIG. 4 is an end view of the pre-form of the grid runner of FIG. 1.
Figure 6:
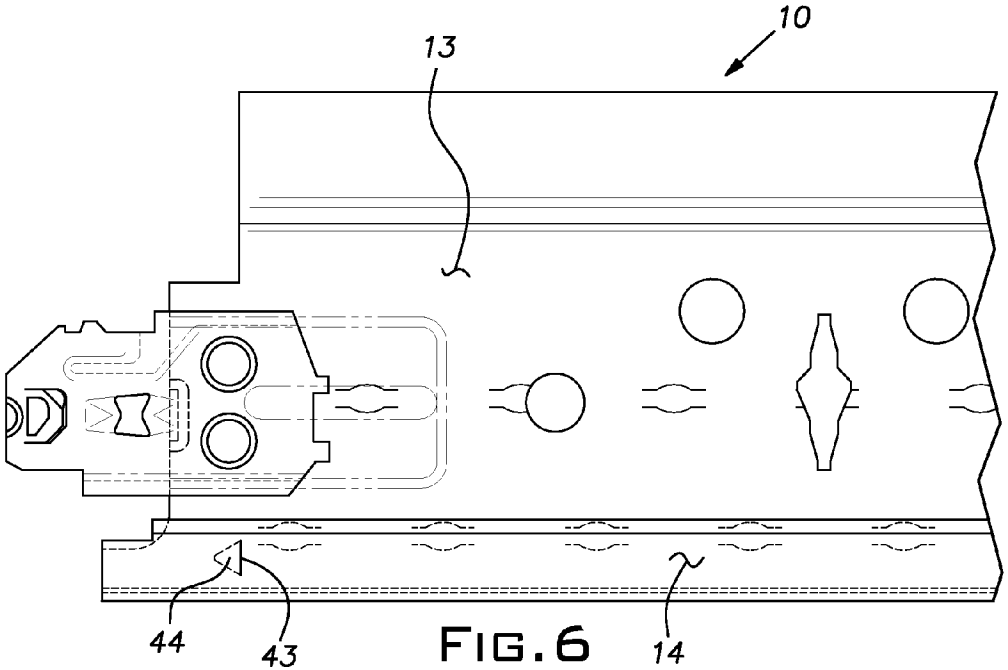
FIG. 6 is a side view of an end of the grid runner of FIG. 1.
Figure 5:
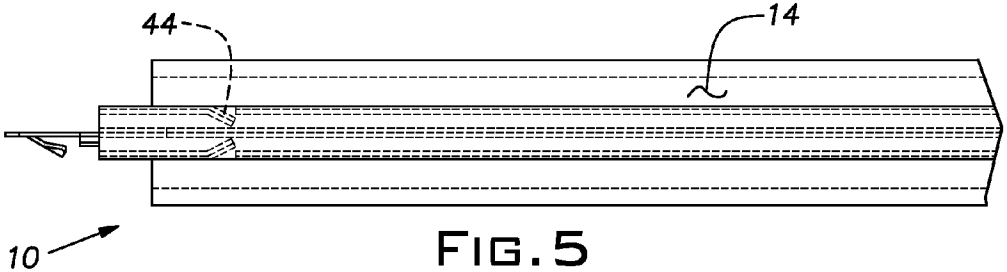
FIG. 5 is a bottom view of an end of the grid runner of FIG. 1.
Figure 7:
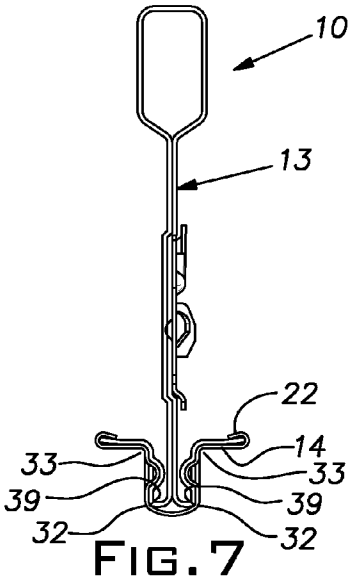
FIG. 7 is an end view of the grid runner of FIG. 1.

The illustrated grid runner 10 is sequentially produced by a roll-forming process, a stamping process, and a second roll-forming process. The roll set of the first process produces the cross-sectional pre-form shape of FIGS. 2-4 which has the general shape of an inverted tee. As shown in FIGS. 2-4, the strip 11 that forms the main body 13 is rolled to a tee shape. The cross-section of the body 13 includes a hollow box-like reinforcing bulb 17, a double layer web 18 and oppositely extending flanges 19 which are perpendicular to the web 18. The layers of the web 18 are locked together by integral stitches 21 known in the art.

The cap 14 covers the lower sides of the flanges 19 and has its longitudinal marginal areas 22 folded over distal edges 23 of the flanges. The described cross-sectional shape of the main body 13 and cap 14 of the pre-form runner 16 are developed, as mentioned, in a roll-forming process. After the main body 13 and cap 14 are roll-formed to the pre-form configuration, the pre-form is rough cut to length and transferred into a press. In the press, the pre-form 16 is cut to a finish length, cross-tee connector slots 24 and hanger holes 25 are stamped, and end connectors 26 are attached in a conventional manner. At this time, the ends of the main body 13 and cap 14 are aligned, i.e. are in a common plane transverse to the longitudinal direction of the pre-form runner 16.

Figure 8:
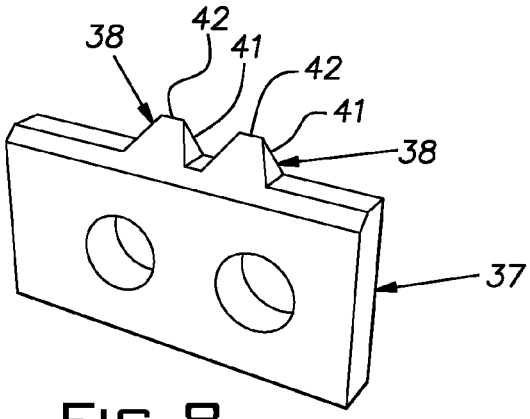
FIG. 8 is a perspective view of a lance insert used in the manufacture of the grid runner of FIG. 1.
Figure 9:
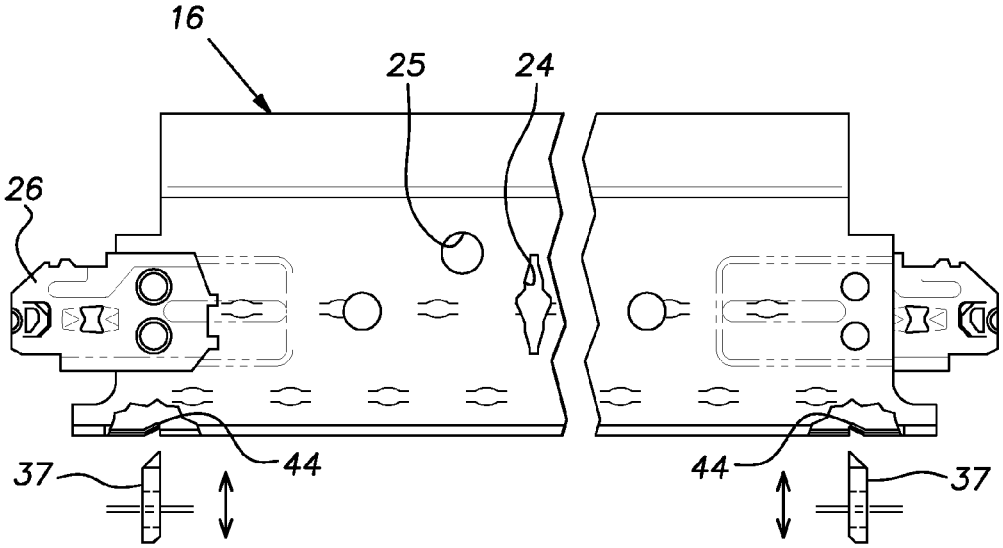
FIG. 9 is a schematic view of a press used for stamping features in the pre-form of FIGS. 2-4.
Figure 10:
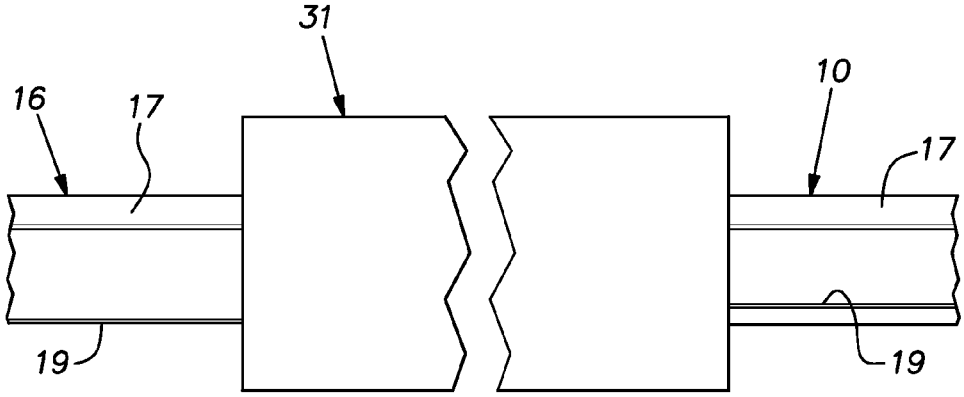
FIG. 10 is a schematic view of a secondary roll set used to roll-form the grid runner of FIG. 1 from the pre-form after the pre-form has been processed in the press of FIG. 9.

From the press, the pre-form 16 is transferred to a second roll set schematically shown at 31 in FIG. 10 where the flanges 19 are each caused to be folded at two substantially 90° bends. The inner bend 32 turns a flange 19 upwardly and the outer bend 33 turns the flange horizontally downward offsetting the inner bend back to the original horizontal orientation.

Where the assembled body and cap strips 11, 12 are finish cut to length and thereafter roll-formed to a different shape, the length of one strip can shrink relative to the other. When the cap 14 shrinks, the main body 13, with a different color, is exposed at the grid runner ends leaving an objectionable appearance. The invention prevents this phenomena by locking the cap 14 to the body 13 against relative longitudinal shrinkage. It has been discovered that the cut body and cap strips 11, 12, can be successfully locked together with small lances 43 and pockets 44 to prevent occurrence of objectionable differences in lengths. FIGS. 8 and 9 illustrate tooling 37 that can be used in the press operation between the first and second roll-forming operations mentioned above. The press, which punches the slots 24 and holes 25, attaches end connectors 26 and cuts the pre-form 16 to length is fitted with the tooling or die inserts 37 adjacent each end of the press. Each insert 37, shown in FIG. 8, has twin cutters 38 spaced so that they pierce the cap 14 and flanges 19 at locations laterally outward of fold lines 39 (FIG. 4) in the flanges 19. The cutters 38 are sloped to each present a single cutting edge 41 at their inner side with reference to the longitudinal direction of the grid runner pre-form 16.

In the illustrated case, a cutter 38 has a configuration that is analogous to a half moon rising smoothly from the body of the cutter insert 37, longitudinally and laterally with reference to the runner pre-form, to an apex 42. The shape of a pocket 44 made in the cap 14 and body 13 is complimentary to that of the cutter 38. Only a single cut line lance 43 is made in the cap 14 and body 13 at each lance location and a smooth transition from the plane of the surrounding cap material exists at the pocket 44. Consequently, the lances 43 and pocket 44 are nearly imperceptible.

The configuration of the lance 43 leaves the displaced cut edge of the cap 14 facing towards the mid-length of the grid runner 10 and an opposed edge of the main body 13 facing in a direction towards the adjacent end of the grid runner. Abutment of these respective cut edges with the pockets 44 is sufficient to anchor the cap 14 against relative shrinkage over the main body 13 so that the ends of the cap and body remain aligned.

When the pre-form runner 16 is passed through a second roll set, as depicted in FIG. 10, the tendency of the cap 14 to shrink relative to the body 13 is resisted by the anchoring action of the lances 43 and pockets 44. As shown, the lances 43 on each end of the grid runner 10 are symmetrically disposed relative to the double layer web 18. When formation of the grid runner 10 is complete, the lances 43 exist on the vertical portions of the flanges 19 and, as a consequence, are less conspicuous than if they existed on the lower horizontal portions of the flanges.

The second roll set can incorporate stages of flattening the lance pocket 44 to further reduce the visibility of the lances 43.

While the disclosure references dimensions in units of inches and feet, it will be understood that the invention is applicable to products of metric equivalents of the dimensions.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A method of making a grid runner comprising the steps of roll forming a main body metal strip and a cap metal strip together to form a pre-form member, cutting both main and cap strips to the same length, stamping details in the main body strip and lancing the main body strip and the cap strip together adjacent the ends of the pre-form member to lock the cap strip against lengthwise movement relative to the main body strip in a press, and thereafter roll-forming the pre-form member to reconfigure both the main body strip and the cap strip into a finished form grid runner.

* * * * *